United States Patent [19]

Pennebaker

[11] 4,227,455

[45] Oct. 14, 1980

[54] SUSPENSION ARRANGEMENT FOR AN OSCILLATING BODY

[75] Inventor: William B. Pennebaker, Carmel, N.Y.

[73] Assignee: International Business Machines Corporation, Armonk, N.Y.

[21] Appl. No.: 974,593

[22] Filed: Dec. 29, 1978

[51] Int. Cl.[3] ..... B41J 7/70

[52] U.S. Cl. ..... 101/93.05; 101/93.04; 101/93.09; 400/119; 400/120; 400/124; 248/178

[58] Field of Search ..... 101/93.09, 93.04, 93.05; 400/119–124; 346/78, 111; 348/178; 310/21, 29, 32

[56] References Cited

U.S. PATENT DOCUMENTS

| | | | |
|---|---|---|---|
| 2,753,176 | 7/1956 | List | 267/1 |
| 2,985,777 | 5/1961 | Merchant | 310/21 |
| 3,295,808 | 1/1967 | Webb | 248/178 |
| 3,742,846 | 7/1973 | Knappe | 400/124 |
| 3,748,553 | 7/1973 | Reiner | 318/128 |
| 3,776,340 | 12/1973 | Moser | 400/124 |
| 3,872,333 | 3/1975 | Imbert et al. | 310/27 |

*Primary Examiner*—Edward M. Coven

*Attorney, Agent, or Firm*—Frank C. Leach, Jr.

[57] ABSTRACT

A body, which oscillates or vibrates at resonance, is suspended from a support structure so that it has spatially linear motion along an axis for a relatively short distance. The body has two connected portions spaced from each other along the axis of motion of the body with each portion connected by leaf springs to a separate intermediate frame. The two intermediate frames are preferably disposed on opposite sides of the axis of motion of the body and connected by additional leaf springs to a main frame, which is suspended by leaf springs from a normally stationary support. If desired, the two intermediate frames may be driven out of phase with each other with one in phase with the body so that the body has a predetermined path different than spatially linear motion without materially affecting the amplitude of motion of the body along its axis of motion.

11 Claims, 6 Drawing Figures

SUSPENSION ARRANGEMENT FOR AN OSCILLATING BODY

In non-impact printers printing non-coded information such as images in a facsimile system, for example, the printing elements must be capable of moving in a spatially linear motion. One previous means of moving the printing elements in a spatially linear motion has been to mount a plurality of printing elements on a carrier, which is supported in bearings and to drive the carrier in opposite directions for relatively short distances.

The suspension arrangement of the present invention avoids the need of any bearings while still having the carrier capable of moving in a spatially linear motion for a relatively short distance. By positioning the printing elements relatively close to each other on the carrier, it is not necessary for the carrier to be moved more than the relatively short distance such as several centimeters, for example, in order for the entire width of a recording medium such as paper, for example, to be covered by the printing elements during movement of the carrier in one direction.

The suspension arrangement of the present invention supports the carrier for spatially linear motion through utilizing leaf spring means between two connected carrier portions, which are spaced from each other in the direction of motion of the carrier, and two separate intermediate frames. Each of the intermediate frames is connected by additional leaf spring means to a main frame, which has a relatively large mass in comparison with the mass of the two intermediate frames, the carrier, and the leaf spring means. The main frame is supported through leaf spring means on normally stationary support means. In addition to being able to have a carrier move in a spatially linear motion without the use of bearings, the same suspension arrangement of the present invention also can compensate for continuous movement of the recording medium relative to the carrier. Thus, the carrier is shifted from its spatially linear motion to a trajectory or path resembling a numeral eight on its side with printing not occurring in the arc portion adjacent each end of the trajectory or path of the carrier.

This compensation, which results in substantially straight raster lines being produced on the continuously moving recording medium, is accomplished through producing a phase shift between the leaf spring means connecting one of the two portions of the carrier to one of the two intermediate frames and the leaf spring means connecting the other of the two portions of the carrier to the other of the two intermediate frames. This phase shift is produced without affecting the force driving the carrier so that the amplitude of movement of the carrier is not changed. Thus, the two intermediate frames are driven with one being driven in phase with the carrier drive force and the other being driven 180° out of phase with the carrier. Therefore, the two drive forces, which produce the out of phase relation between the two intermediate frames, have no effect on the amplitude of motion of the carrier along its axis of motion since the drive forces cancel each other along the axis of motion of the carrier.

An object of this invention is to provide a suspension arrangement for a vibrating or oscillating body in which the body has spatially linear motion over a relatively short distance.

Another object of this invention is to provide an oscillating carrier for non-impact printing in which the carrier has spatially linear motion over a relatively short distance.

A further object of this invention is to provide an oscillating body having a spatially linear motion over a relatively short distance without the requirement of bearings.

Still another object of this invention is to provide a suspension arrangement for a body vibrating or oscillating at a resonant frequency so that the body has spatially linear motion over a relatively short distance.

The foregoing and other objects, features, and advantages of the invention will be apparent from the following more particular description of the preferred embodiment of the invention as illustrated in the accompanying drawings. In the drawings.

Figure 1:
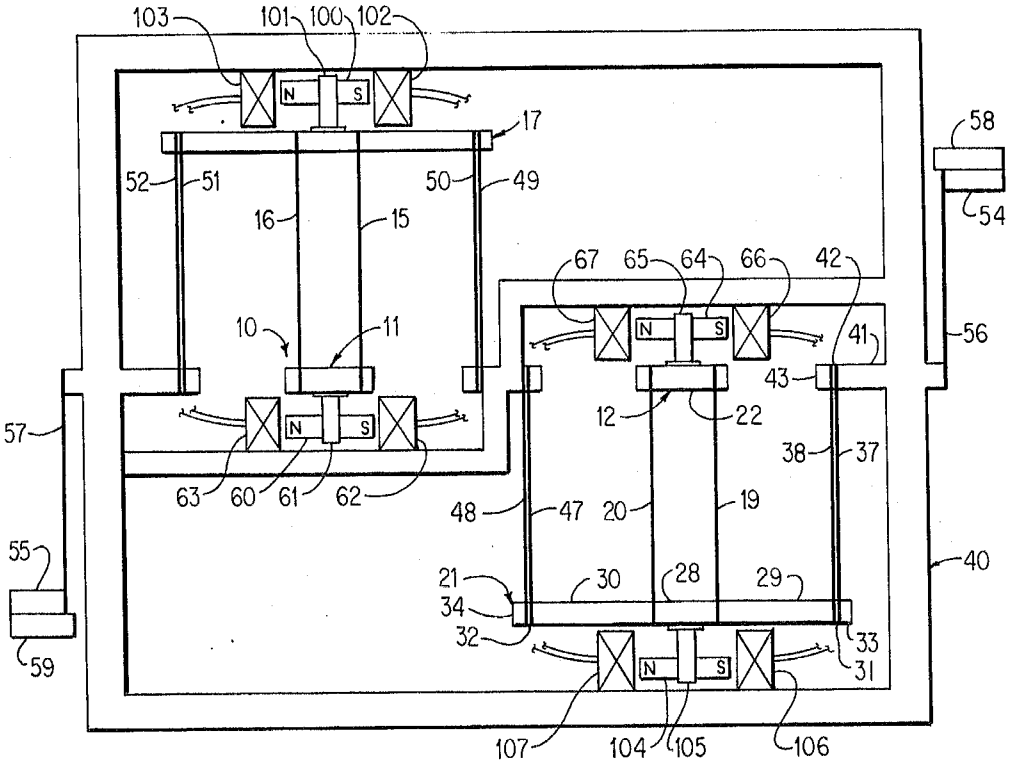
FIG. 1 is a schematic elevational view of a suspension arrangement for a vibrating or oscillating carrier with the carrier at rest.

Referring to the drawings and particularly FIG. 1, there is shown a carrier or body 10 including a first portion 11 and a second portion 12. The portions 11 and 12 of the carrier 10 are spaced from each other along an axis on which the carrier 10 moves during its oscillation.

Each of the portions 11 and 12 of the carrier 10 is connected to a frame 14 (see FIG. 2) by suitable means such as welding, for example. Thus, the portions 11 and 12 and the frame 14 form a unitary assembly.

The portion 11 of the carrier 10 has a pair of leaf springs 15 (see FIG. 1) and 16, which are substantially parallel to each other when the carrier 10 is at rest, extending therefrom substantially perpendicular to the axis along which the carrier 10 has the spatially linear motion during its oscillation or vibration at resonance. One end of each of the leaf springs 15 and 16 is connected to a first intermediate frame 17.

The second portion 12 of the carrier 10 has a pair of leaf springs 19 and 20, which are substantially parallel to each other when the carrier 10 is at rest, extending therefrom in a direction substantially perpendicular to the axis along which the carrier 10 has its spatially linear motion. One end of each of the leaf springs 19 and 20 is connected to a second intermediate frame 21, which is disposed on the opposite side of the axis to the first intermediate frame 17.

Figure 2:
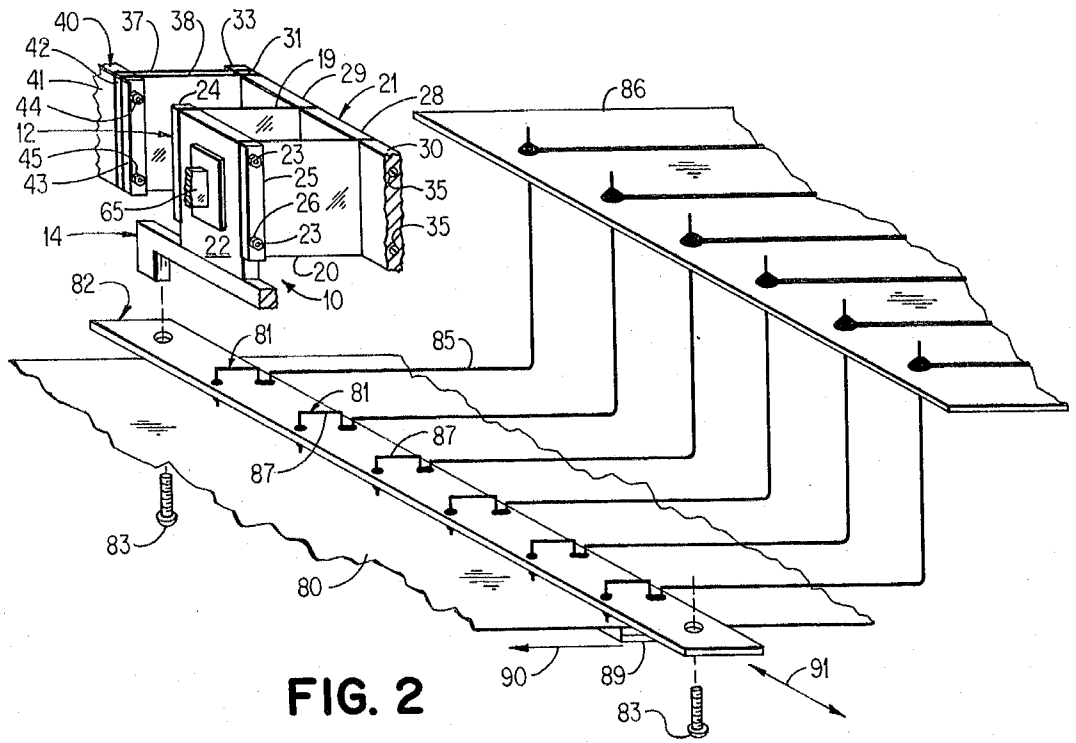
FIG. 2 is a perspective view of a portion of a printer including a portion of the carrier of the suspension arrangement of FIG. 1 with the carrier utilized as a printing carrier for non-impact printing.

As shown in FIG. 2, the second portion 12 of the carrier 10 includes a plate 22 having one end of each of the leaf springs 19 and 20 secured thereto by bolts 23 extending through the plate 22 and end blocks 24 and 25 on opposite ends of the plate 22. A nut 26 is secured to each end of each of the bolts 23 to retain the plate 22, the springs 19 and 20, and the end blocks 24 and 25 in a unitary assembly.

The second intermediate frame 21 includes a central plate 28, end plates 29 and 30, spacers 31 and 32 (see FIG. 1), and end blocks 33 (see FIG. 2) and 34 (see FIG. 1). One end of the leaf spring 19 (see FIG. 2) is disposed between the central plate 28 and the end plate 29, and one end of the leaf spring 20 is disposed between the central plate 28 and the end plate 30. The central plate 28, the end plates 29 and 30, the spacers 31 and 32 (see FIG. 1), and the end blocks 33 (see FIG. 2) and 34 (see FIG. 1) are secured to each other by bolts 35 (see FIG. 2) and nuts (not shown) in the same manner as the bolts 23 and the nuts 26 cooperate to form the second portion 12 of the carrier 10.

The second intermediate frame 21 has a pair of leaf springs 37 and 38, which are substantially parallel to each other when the carrier 10 is at rest, extending therefrom for connection to a main support frame 40. The leaf spring 38 has one end disposed between the end plate 29 and the spacer 31 while the leaf spring 37 has one end disposed between the spacer 31 and the end block 33.

The leaf springs 37 and 38 extend substantially parallel to the leaf springs 19 and 20 when the carrier 10 is at rest and are connected at their other ends to the main frame 40. The main frame 40 has an extending portion 41, a spacer 42, and an end block 43 with one end of the leaf spring 37 disposed between the end of the portion 41 and the spacer 42 and one end of the leaf spring 38 disposed between the spacer 42 and the end block 43. The leaf springs 37 and 38 are retained in position with the spacer 42 and the end block 43 by bolts 44 and nuts 45.

The other end of the second intermediate frame 21 is similarly resiliently suspended from the frame 40 through a pair of leaf springs 47 (see FIG. 1) and 48, which are substantially parallel to each other and to the leaf springs 37 and 38 when the carrier 10 is at rest. The leaf springs 47 and 48 are connected to the frame 40 in a manner similar to that in which the leaf springs 37 and 38 are connected.

The first intermediate frame 17 has a pair of leaf springs 49 and 50, which are substantially parallel to each other and to the leaf springs 15 and 16 when the carrier 10 is at rest, connecting the first intermediate frame 17 to the main frame 40. The leaf springs 49 and 50 are connected in a manner similar to that shown and described for the leaf springs 37 and 38.

The first intermediate frame 17 is connected by a second pair of leaf springs 51 and 52, which are substantially parallel to each other and to the leaf springs 15 and 16 when the carrier 10 is at rest, to the main frame 40. The leaf springs 51 and 52 are connected in a manner similar to that in which the leaf springs 37 and 38 are connected.

The main frame 40, which has a mass substantially greater than the total mass of the carrier 10 and the intermediate frames 17 and 21, is resiliently supported from normally stationary supports 54 and 55 through leaf springs 56 and 57, respectively. The leaf springs 56 and 57 are connected to the main frame 40 and the supports 54 and 55 in a manner similar to that described for the leaf springs 19 and 20 or the leaf springs 37 and 38. The leaf spring 56 is secured to the main frame 40 by the bolts 44 (see FIG. 2), which also secure the leaf springs 37 and 38 to the main frame 40, and the nuts 45.

The normally stationary supports 54 (see FIG. 1) and 55 have stops 58 and 59, respectively, to limit the amount of movement of the main frame 40 by the leaf springs 56 and 57 if the normally stationary supports 54 and 55 are suddenly disturbed. Each of the stops 58 and 59 preferably incorporates suitable mechanical damping means such as a greased fitting, for example, to quickly dampen any excessive motion of the main frame 40 if the normally stationary supports 54 and 55 should be suddenly disturbed. It should be understood that the slight vibration of the main frame 40 relative to the normally stationary supports 54 and 55 is too small to introduce any significant non-linearity in the motion of the carrier 10 and the intermediate frames 17 and 21 relative to the main frame 40.

The resonant frequency of vibration or oscillation of the carrier 10 is selected so that the carrier 10 and the intermediate frames 17 and 21 vibrate in phase with each other and out of phase with the main frame 40. To the extent that the masses of the leaf springs 15, 16, 19, and 20 can be neglected, the resonant frequency of the carrier 10 is defined by $f=(k/2m)^{\frac{1}{2}}/2\pi$ where f is the resonant frequency of the carrier 10, k is the spring constant of the leaf springs 15, 16, 19, and 20, and m is the mass of the carrier 10.

When the carrier 10 moves to the right in FIG. 1, the leaf springs 15 and 16 flex to cause the intermediate frame 17 to also move to the right. Similarly, the leaf springs 19 and 20 flex to move the second intermediate frame 21 to the right.

When the leaf springs 15 and 16 flex, the force due to the oscillation of the carrier 10 is transmitted along the leaf springs 15 and 16 to the first intermediate frame 17 to also cause flexing of the leaf springs 49 and 50 and the leaf springs 51 and 52. Similarly, the leaf springs 19 and 20 transmit force to the second intermediate frame 21 to also cause flexing of the leaf springs 37 and 38 and the leaf springs 47 and 48.

It is necessary for the degree of bending of the leaf springs 49 and 50 and the leaf springs 51 and 52 to be the same as the degree of bending of the leaf springs 15 and 16 and the degree of bending of the leaf springs 37 and 38 and the leaf springs 47 and 48 to be the same as the degree of bending of the leaf springs 19 and 20. This is accomplished through selectively choosing the stiffness of the leaf springs 49 and 50 and the leaf springs 51 and 52 and the mass of the first intermediate frame 17 and the stiffness of the leaf springs 37 and 38 and the leaf springs 47 and 48 and the mass of the second intermediate frame 21 relative to the stiffness of the leaf springs 15, 16, 19, and 20, and the mass of the carrier 10.

The flexing of the leaf springs 49 and 50 and the leaf springs 51 and 52 because of movement of the carrier 10 to the right in FIG. 1 produces a small displacement of the second intermediate frame 17 in a direction towards the connections of the leaf springs 49–52 to the main frame 40 (i.e., in a direction towards the carrier 10). A similar displacement occurs for the second intermediate frame 21 but in the opposite direction to the direction of displacement of the first intermediate frame 17.

These small displacements of the first intermediate frame 17 and the second intermediate frame 21 are in the opposite directions to that in which the first portion 11 of the carrier 10 and the second portion 12 of the carrier 10 are displaced in a direction substantially perpendicular to the axis along which the carrier 10 moves.

With the displacement of the first portion 11 of the carrier 10 being the same amount as the first intermediate frame 17 and the displacement of the second portion 12 of the carrier 10 being the same amount as the second intermediate frame 21 but in opposite directions, the small displacements cancel each other.

Accordingly, the carrier 10 has spatially linear motion along the axis on which it moves. This is accomplished because the bending or flexing of the leaf springs 15 and 16 is the same as the bending or flexing of the leaf springs 49–52 and the bending or flexing of the leaf springs 19 and 20 is the same as the bending or flexing of the leaf springs 37, 38, 47, and 48. Thus, the utilization of the intermediate frames 17 and 21 along with their connecting leaf springs produces the desired spatially linear motion of the carrier 10 since all other displacements are cancelled. It should be understood that the carrier 10 reverses its direction because of the flexing of the leaf springs 15, 16, 19, 20, 37, 38, and 47–52.

There is lost energy in the suspension arrangement of the present invention due to air viscosity and stray mechanical damping effects. Accordingly, the present invention compensates for this lost energy so that the carrier 10 will continue to oscillate or vibrate at its selected resonant frequency.

To compensate for this energy loss, the carrier 10 has a mechanical force applied thereto along the axis on which the carrier 10 moves in its spatially linear motion. Accordingly, the carrier 10 has a permanent magnet 60 supported in a bracket 61, which is mounted on the first portion 11 of the carrier 10 in any suitable manner. An electromagnetic coil 62, which is supported by the main frame 40, is disposed adjacent the magnet 60 at its South pole and an electromagnetic coil 63, which is supported by the main frame 40, is disposed adjacent the magnet 60 at its North pole.

When current flows in one direction through each of the electromagnetic coils 62 and 63, which are wired so that the forces exerted on the magnet 60 are additive, the magnet 60 has its South pole, for example, attracted to the coil 62 by the field of the coil 62 and its North pole repelled from the coil 63 by the field of the coil 63 so that the force is applied to the carrier 10 to move the carrier 10 to the right in FIG. 1. When the direction of the DC current is reversed, the fields produced by the electromagnetic coils 62 and 63 are reversed so that magnet 60 has its North pole attracted to the coil 63 by the field of the coil 63 and its South pole repelled from the coil 62 by the field of the coil 62 whereby the force acts on the carrier 10 to move the carrier 10 to the left in FIG. 1. Therefore, the magnet 60 and the coils 62 and 63 cooperate to drive the carrier 10 along the axis of its spatially linear motion to compensate for the lost energy.

The second portion 12 of the carrier 10 supports a permanent magnet 64 on the bracket 65, which is mounted on the plate 22 (see FIG. 2) by suitable means such as welding, for example. An electromagnetic coil 66 (see FIG. 1), which is supported on the main frame 40, is disposed adjacent the magnet 64 at its South pole, and an electromagnetic coil 67, which is supported on the main frame 40, is disposed adjacent the magnet 64 at its North pole.

When the magnet 64 moves with the carrier 10 during movement of the carrier 10 to the right in FIG. 1, the South pole of the magnet 64 approaches the coil 66 and the North pole of the magnet 64 moves away from the coil 67 to produce fields therein in the same direction. Thus, the coils 66 and 67 sense the motion of the carrier 10 to the right. Motion of the carrier 10 to the left is sensed by the coils 66 and 67 when the magnet 64 has its North pole moved closer to the coil 67 and its South pole moved away from the coil 66.

Figure 4:
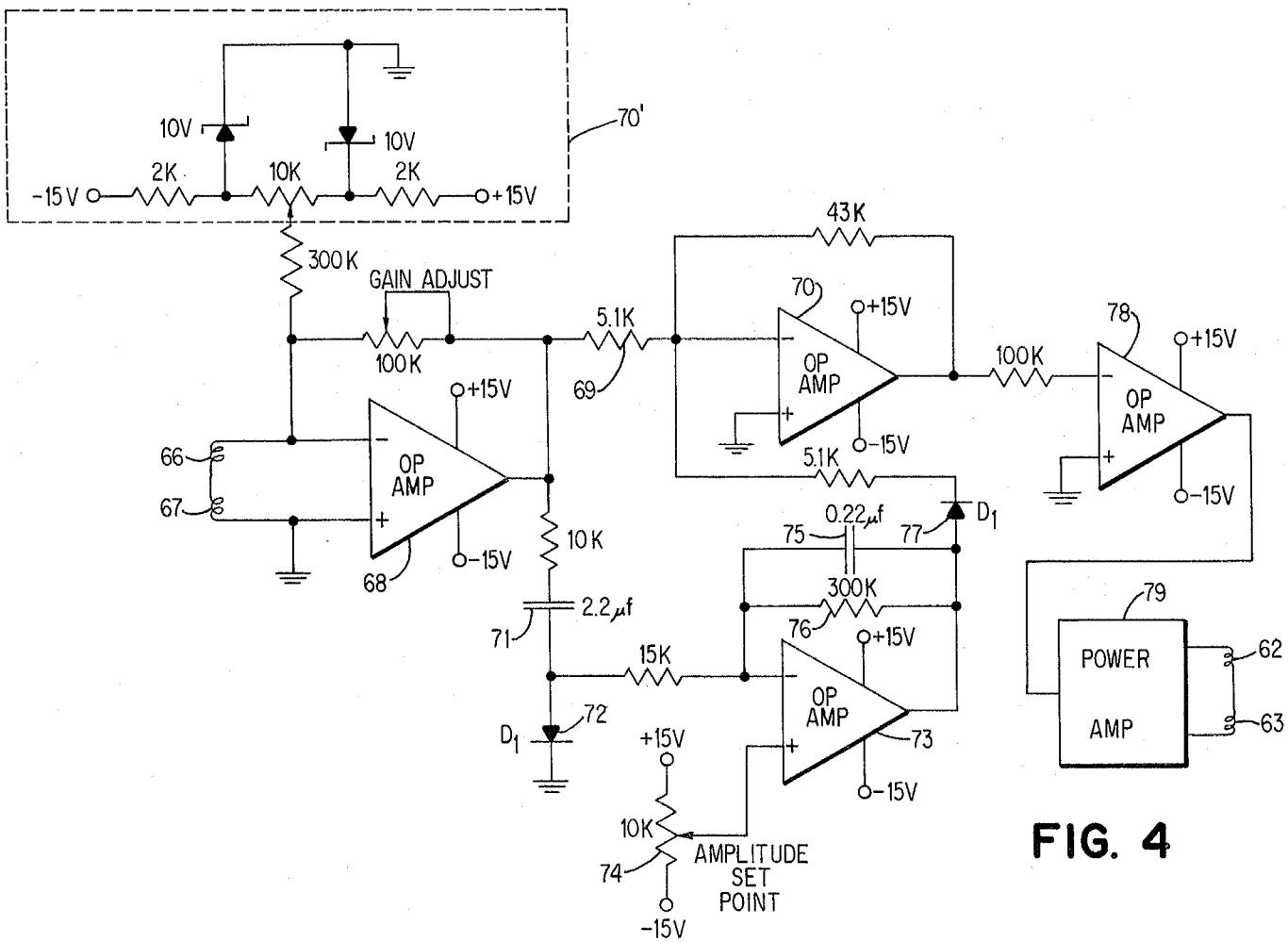
FIG. 4 is a diagram of an electric circuit for utilization with the carrier of the suspension arrangement of FIG. 1.

The movement of the carrier 10 by both the spring system and the forces of the coils 62 and 63 on the magnet 60 is sensed by the coils 66 and 67, which are wired to produce an additive signal. The coils 66 and 67 are connected to an operational amplifier 68 (see FIG. 4), which can be part of a quad op-amp package sold by National Semiconductor Corporation as model LM 224.

The input signal to the operational amplifier 68 is primarily determined by the velocity of the carrier 10 (see FIG. 1). Thus, when the carrier 10 has started from the left to move to the right in FIG. 1, for example, its velocity increases until it reaches the midpoint of its travel and then it decreases. This velocity change produces the substantially sinusoidal output signal from the operational amplifier 68 (see FIG. 4).

The approximately sinusoidal output of the operational amplifier 68 is connected through a resistor 69 to a summing point of an operational amplifier 70, which also is part of the same quad op-amp package as the operational amplifier 68. Any DC bias in the output of the operational amplifier 68 is eliminated by means of an offset adjustment network 70'. The output of the operational amplifier 68 also is supplied through a capacitor 71 to a diode 72, which has its anode connected to the negative input of an operational amplifier 73. The operational amplifier 73 also is part of the same quad op-amp package as the operational amplifier 68 and the operational amplifier 70.

The operational amplifier 73 has its positive input connected to a potentiometer 74 to provide an amplitude set point, which is a negative voltage. The amplitude set point is selected so that the operational amplifier 73 regulates the amount of energy supplied to the coils 62 and 63 to control the amplitude of the carrier 10 whereby the carrier 10 always has substantially the same spatially linear motion in each direction along its axis.

The operational amplifier 73 has an integrating capacitor 75 and a resistor 76 connected in parallel with each other. The capacitor 75 and the resistor 76 are connected between the output of the operational amplifier 73 and its negative input. The capacitor 75 integrates the signals, which are rectified by the diode 72, from the output of the operational amplifier 68. The resistor 76 determines the DC gain of the operational amplifier 73.

Thus, when the average amplitude of the rectified output from the operational amplifier 68 becomes more negative than a predetermined negative voltage set by the potentiometer 74, the amplitude of the spatially linear motion of the carrier 10 (see FIG. 1) is greater than desired due to the coils 62 and 63 supplying too much energy thereto through the magnet 60. Accordingly, when the rectified output from the operational amplifier 68 (see FIG. 4) becomes more negative on the average than the output from the potentiometer 74, the operational amplifier 73 produces a positive DC output.

If the negative voltage from the potentiometer 74 is more negative than the average rectified voltage from the operational amplifier 68, the operational amplifier 73 has a negative DC output. However, the negative DC output from the operational amplifier 73 is not supplied to the summing point of the operational amplifier 70 because a diode 77 allows only the positive output from the operational amplifier 73 to be supplied to the summing point of the operational amplifier 70.

The positive DC output from the operational amplifier 73 is added to the sinusoidal current from the operational amplifier 68 to change the zero crossing point so that the positive portion of the total signal to the operational amplifier 70 is up prior to the time that the sinusoidal current from the operational amplifier 68 goes positive and stays up for a period of time after the sinusoidal current from the operational amplifier 68 goes negative. This results in a positive signal being supplied to the operational amplifier 70 for a longer period of time than a negative signal during each cycle of the carrier 10 (see FIG. 1).

The output of the operational amplifier 70 (see FIG. 4) is supplied to the negative output of an operational amplifier 78, which is part of the same quad op-amp package as the operational amplifiers 68, 70, and 73. The operational amplifier 78 amplifies the signal from the operational amplifier 70 to saturation so that its output is a square wave. When the input signal to the operational amplifier 70 has a DC component from the operational amplifier 73, the positive square wave signal from the operational amplifier 78 is extended and the negative square wave signal is shortened.

The operational amplifier 78 supplies its output to a power amplifier 79, which amplifies the square wave output for supply to the coils 62 and 63. One suitable example of the power amplifier 79 is a bipolar operational amplifier sold by Kepco Incorporated, Flushing, New York as model BOP72-5M.

The coils 62 and 63 are connected to the power amplifier 79 so that the forces exerted on the magnet 60 (see FIG. 1) are additive so that positive mechanical feedback is obtained. Positive mechanical feedback is obtained when the force exerted on the magnet 60 is in the same direction as the velocity of the carrier 10.

The extension of the positive square wave output signal from the operational amplifier 78 (see FIG. 4) and the concomitant shortening of the negative square wave output signal from the operational amplifier 78 result in the forces supplied by the coils 62 and 63 retarding the motion of the carrier 10 (see FIG. 1) during that part of the oscillatory cycle where the output of the operational amplifier 78 (see FIG. 4) is positive and the output of the operational amplifier 68 is negative. This reduces the net power delivered to the carrier 10 (see FIG. 1) through the coils 62 and 63. Therefore, the net energy delivered to the carrier 10 is controlled by the amplitude set point of the potentiometer 74 (see FIG. 4) so that the carrier 10 (see FIG. 1) has the desired amplitude in its spatially linear motion in each direction along the axis.

The carrier 10 may be utilized in a non-impact printing system having a recording medium such as a paper 80 (see FIG. 2), for example. The paper 80 can be an electro-erosion paper, for example.

A plurality of stylus assemblies 81 is mounted on a board 82, which can be a printed circuit board, for example, secured to the carrier 10. The board 82 is connected to opposite ends of the carrier frame 14 of the carrier 10 by suitable means such as screws 83, for example.

Each of the stylus assemblies 81 is connected through a flexible spring electrical head 85 to a stationary control circuit board 86. The lead 85 is electrically connected to a wire 87, which is carried by the board 82, of the stylus assembly 81. The lead 85 and the wire 87 are preferably electrically connected to each other through solder, which mechanically bonds the lead 85 and the wire 87 to the board 82.

Figure 3:
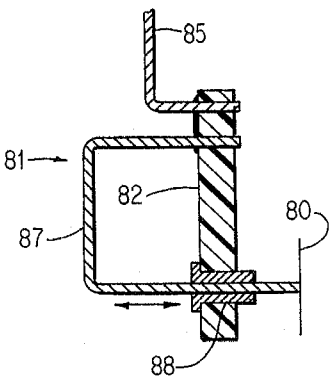
FIG. 3 is a sectional view of a stylus assembly for mounting on the carrier of the printer of FIG. 2.

The wire 87 extends through a guide 88 (see FIG. 3), which is formed of graphite, for example, in the board 82. The wire 87 continuously engages the paper 80, which has a support 89 (see FIG. 2) behind it at least in the area in which the wire 87 is engaging the paper 80. The guide 88 (see FIG. 3) enables the wire 87 to continuously engage the paper 80 even as the wire 87 wears because of riding along the surface of the paper 80.

The paper 80 moves in the direction indicated by an arrow 90 in FIG. 2. This direction is substantially perpendicular to the axis along which the carrier 10 oscillates. The directions of spatially linear motion of the carrier 10 along its axis are indicated by arrows 91 in FIG. 2.

The wire 87 of each of the stylus assemblies 81 is controlled from suitable electronic control circuits to either carry current or not carry current at each of a plurality of positions to which the wire 87 is moved during motion of the carrier 10 along its axis. The area covered by the wire 87 of each of the stylus assemblies 81 during reciprocating motion of the carrier 10 is such that it slightly overlaps the area covered by the wire 87 of each of the adjacent stylus assemblies 81.

The paper 80 can either be indexed after motion of the carrier 10 is completed in each direction or be continuously moved. When the paper 80 is indexed at the completion of motion of the carrier 10 in each direction, a continuous straight line is produced by the spatially linear motion of the carrier 10 along its axis.

However, if there is continuous motion of the paper 80 during motion of the carrier 10, then there must be compensation for this continuous relative motion between the paper 80 and the carrier 10 due to the paper 80 continuously moving to enable the stylus assemblies 81 to produce substantially straight raster lines across the width of the paper 80. This can be accomplished by tilting the motion of the paper 80 relative to the motion of the carrier 10 along its axis or vice versa if the printing is to occur for movement of the carrier 10 in only one direction.

Another means for compensation for continuous movement of the paper 80 is to introduce a phase shift between the intermediate frames 17 (see FIG. 1), and 21. This allows printing during movement of the carrier 10 in both directions.

The phase shift is in opposite directions so that the amplitude of motion of the carrier 10 is not affected while the motion of the carrier 10 is changed from its spatially linear motion along the axis to a predetermined path or trajectory 92 (see FIG. 5) producing the numeral eight on its side. The direction of the paper 80 is indicated by an arrow 93 in FIG. 5. This type of motion results in printing only after the carrier 10 has completed each of the end arcs of the numeral eight. Because of the continuously moving paper 80, printing occurs during movement of the carrier 10 along the path or trajectory from substantially the time that the arc at the end of the numeral eight ceases to be formed until formation of the next arc at the other end of the numeral eight is started. This produces a substantially straight raster line because of the relative movement of the paper 80.

Figure 6:
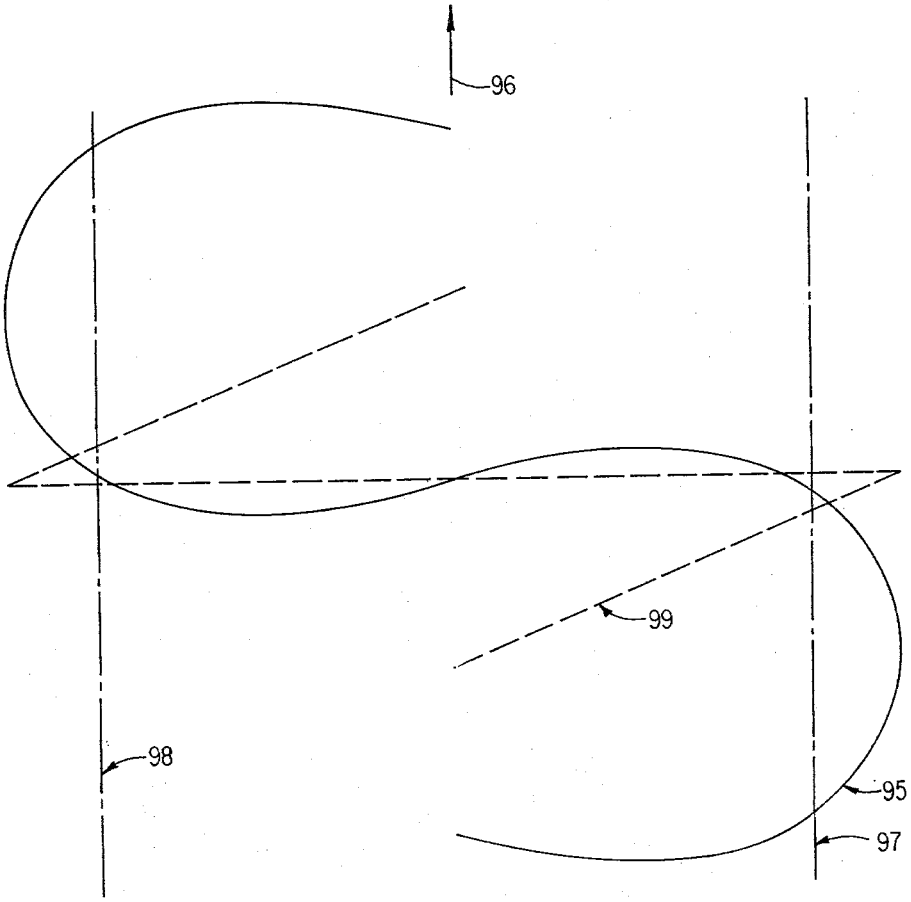
FIG. 6 is a schematic view of paths produced on the continuously moving medium by a printing element on the carrier of the suspension arrangement of the present invention when there is compensation for continuous movement of the recording medium relative to the carrier.

As shown in FIG. 6, the path of one of the wires 87 (see FIG. 2) of one of the stylus assemblies 81 along the continuously moving paper 80 produces a solid line curve 95 with an arrow 96 indicating the direction of motion of the paper 80. Printing occurs between lines 97 and 98.

A dotted line 99 also is shown in FIG. 6. The line 99 indicates the path on the paper 80 (see FIG. 2) of the wire 87 of one of the stylus assemblies 81 when the paper 80 is tilted and the carrier 10 moves in a predetermined path similar to the path 92 of FIG. 5 but slightly smaller. The movement of the carrier 10 (see FIG. 2) in the predetermined path along with tilting of the paper 80 produces a straighter raster line than is obtained with mere tilting of the paper 80 for printing in only one direction of motion of the carrier 10.

Figure 5:
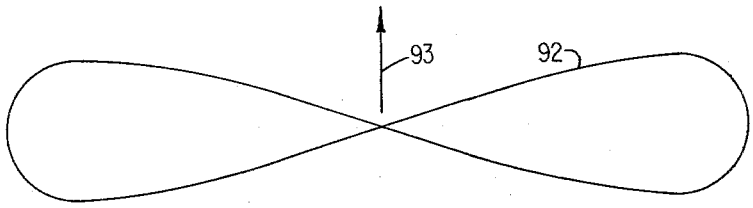
FIG. 5 is a schematic view showing the path of movement of the carrier when compensation is made for continuous movement of a recording medium with which printing elements on the carrier cooperate.

Because of the tilting of the paper 80, the predetermined path of the carrier 10 moves only about one-fifth of the distance from the axis along which the carrier 10 has spatially linear motion than the carrier 10 moved to produce the path 92 of FIG. 5 when the paper 80 (see FIG. 2) is not tilted and printing is to occur in both directions of movement of the carrier 10.

The phase shift between the intermediate frames 17 (see FIG. 1) and 21 can be accomplished through driving each of the intermediate frames 17 and 21 separately. The intermediate frame 17 has a permanent magnet 100 supported by a bracket 101, which is mounted on the first intermediate frame 17 in the same manner as the bracket 65 is supported on the plate 22 of the second portion 12 of the carrier 10. An electromagnetic coil 102, which is supported on the main frame 40, is disposed adjacent the magnet 100 at its South pole, and an electromagnetic coil 103, which is supported on the main frame 40, is disposed adjacent the magnet 100 at its North pole. Thus, when the electromagnetic coils 102 and 103, which are wired so that the forces acting on the magnet 100 are additive, have a direct current supplied thereto in one direction, the magnet 100 has its South pole attracted to the coil 102 by the electromagnetic field generated thereby and its North pole repelled from the coil 103 by its electromagnetic field. This shifts the first intermediate frame 17 to the right in FIG. 1.

When the electromagnetic coils 102 and 103 receive the direct current in the opposite direction, the electromagnetic field produced by the coil 103 attracts the North pole of the magnet 100 to the coil 103 while the South pole of the magnet 100 is repelled from the coil 102 by the field created by the coil 102. This results in the first intermediate frame 17 moving to the left in FIG. 1.

The second intermediate frame 21 has a permanent magnet 104 supported by a bracket 105, which is supported on the second intermediate frame 21 in the same manner as the bracket 65 is supported on the plate 22 of the second portion 12 of the carrier 10. An electromagnetic coil 106, which is supported on the frame 40, is disposed adjacent the magnet 104 at its South pole, and an electromagnetic coil 107, which is supported on the frame 40 is disposed adjacent the magnet 104 at its North pole.

Accordingly, when the coils 106 and 107, which are wired so that the forces acting on the magnet 104 are additive, have DC current flowing therethrough in one direction, the electromagnetic field produced by the current flowing through the coil 106 attracts the South pole of the magnet 104 to the coil 106 while the electromagnetic field produced by the coil 107 repels the North pole of the magnet 104 from the coil 107. This results in shifting the second intermediate frame 21 to the right in FIG. 1.

When the direct current is supplied to the electromagnetic coils 106 and 107 in the opposite direction, the electromagnetic field produced by the coil 106 repels the South pole of the magnet 104 from the coil 106 while the electromagnetic field created by the coil 107 attracts the North pole of the magnet 104 towards the coil 107. This shifts the second intermediate frame 21 to the left in FIG. 1.

Accordingly, by controlling the application of the current to the coils 102 and 103 and the coils 106 and 107, the first intermediate frame 17 and the second intermediate frame 21 can be shifted in opposite directions at the same time. As a result, the path of the carrier 10 will no longer have a spatially linear motion along the axis but will have the path 92 (see FIG. 5), which is the numeral eight on its side. This enables printing to occur along the substantially straight line on the continuously moving paper 80 (see FIG. 2) during movement of the carrier 10 in both directions.

As previously mentioned, the carrier 10 oscillates or vibrates at a resonant frequency. This resonant frequency is one of four resonant modes of vibrations at which the suspension arrangement of FIG. 1 could vibrate.

The lowest of these four modes of vibrations is where the main frame 40, the carrier 10, and all the connected structure therebetween vibrate in phase relative to the normally stationary supports 54 and 55. In this mode of vibration, the only springs would be the springs 56 and 57, and these would have a low or weak spring constant. Since there are other springs utilized in the suspension arrangement, this mode of vibration does not occur and would be suppressed by damping at the stops 58 and 59.

The next highest mode of vibration, which has a higher frequency than the prior mode, is the desired mode. In this mode, the carrier 10 and the intermediate frames 17 and 21 vibrate in phase with each other and out of phase with the main frame 40. This mode is excited by sensing motion of the carrier 10 through the coils 66 and 67 and supplying positive mechanical feedback forces through the coils 62 and 63.

The next mode of vibration, which has a higher frequency than the prior mode, is where the intermediate frames 17 and 21 vibrate out of phase with each other and the carrier 10 is essentially stationary. This mode transmits torque to the normally stationary supports 54 and 55 so that it must be avoided. This mode is avoided through driving the carrier 10 by the coils 62 and 63 so that the carrier 10 can never be stationary.

The highest frequency of vibration is a mode in which the intermediate frames 17 and 21 vibrate in phase with one another but out of phase with the carrier 10. Since the force supplied by the coils 102 and 103 is always out of phase with the force supplied by the coils 106 and 107, this mode is never excited when the coils 102, 103, 106, and 107 are activated.

These four modes of resonant frequency substantially differ from each other. Thus, the selection of the desired mode is guaranteed by the coils 66 and 67 sensing motion of the carrier 10 and the coils 62 and 63 providing positive mechanical feedback to the carrier 10.

To the extent that the total mass of the leaf springs 15, 16, 19, 20, 37, 38, and 47–52 can be neglected, the relation of the mass of the carrier 10 and the mass of each of the intermediate frames 17 and 21 relative to the spring constants of the leaf springs 15, 16, 19, 20, 37, 38, and 47–52 is defined by the equation $m=2k-2$ where m is the ratio of the total mass of the intermediate frames 17 and 21 to the mass of the carrier 10 and k is the ratio of the sum of the spring constants of the leaf springs 37, 38, and 47–52 to the sum of the spring constants of the leaf springs 15, 16, 19, and 20. In practice, the total mass of the leaf springs 15, 16, 19, 20, 37, 38, and 47–52 is not negligible so that the ratio of the total mass of the intermediate frames 17 and 21 to the mass of the carrier 10 must be slightly smaller than that determined by the equation $m=2k-2$ if precise spatially linear motion of the carrier 10 is to be achieved at resonance for the specific spring constants.

As an example, if each of the leaf springs 15, 16, 19, 20, 37, 38, and 47–52 had the same constant, then $k=2$ since there are twice as many of the leaf springs 37, 38, and 47–52 as the leaf springs 15, 16, 19, and 20. Thus, from the equation $m=2k-2$, $m=2$ whereby the mass of each of the intermediate frames 17 and 21 would be the same as the mass of the carrier 10. However, because the total mass of the leaf springs 15, 16, 19, 20, 37, 38, and 47–52 is not negligible, the mass of the carrier 10 must be slightly larger than the mass of each of the intermediate frames 17 and 21.

The main frame 40 normally has a mass at least one order of magnitude greater than the total mass of the carrier 10 and the intermediate frames 17 and 21. However, this is not a requisite for satisfactory operation.

As the mass of the main frame 40 increases relative to the total mass of the carrier 10 and the intermediate frames 17 and 21, the amplitude of vibration of the main frame 40 becomes smaller relative to the amplitude of movement of the carrier 10 and the intermediate frames 17 and 21. It is desired that the amplitude of the main frame 40 be as small as possible so that the main frame 40 could have a mass fifty times greater than the total mass of the carrier 10 and the intermediate frames 17 and 21, for exapmle.

While the paper 80 has been described as being an electroerosion paper, other suitable types of paper could be employed. For example, a dielectric paper could be utilized. With the paper 80 being a dielectric paper, the wires 87 could be continuously energized for the desired distance during which printing is to occur rather than pulsed as is required for the electroerosion paper. Of course, when the paper 80 is a dielectric paper, it is necessary to subsequently apply a toner in accordance with the charge pattern produced on the dielectric paper.

While printing on the paper 80 has occurred through having the wires 87, which are the printing elements, in continuous contact with the paper 80, it should be understood that such is not a requisite. Thus, the printing elements could be ink jet nozzles provided that asynchronuous printing is employed rather than synchronuous printing. This is because the velocity of the carrier 10 (see FIG. 1) is not constant so that it would be very difficult to have the ink droplets from the ink nozzles utilize synchronuous ink droplet printing.

While the carrier 10 has been shown and described as being utilized for printing, it should be understood that the suspension arrangement of the present invention may be utilized in any environment in which it is desired for a body to move in a spatially linear motion when vibrating or oscillating at a resonant frequency. For example, the body could be an optical scanner for scanning a mirror of a laser liquid crystal display.

An advantage of this invention is that no net torque is applied to the frame for a vibrating carrier system. Another advantage of this invention is that there is no requirement for a vibrating counterbalance. A further advantage of this invention is that no precise tuning is required. Still another advantage of this invention is that it provides a relatively compact structure. A still further advantage of this invention is that it eliminates the need for bearings to support a carrier while obtaining spatially linear motion of a carrier.

While the invention has been particularly shown and described with reference to a preferred embodiment thereof, it will be understood by those skilled in the art that various changes in form and details may be made therein without departing from the spirit and scope of the invention.

What is claimed is:

1. A suspension arrangement including:

an oscillating body movable along an axis at a selected resonant frequency;

intermediate frame means spaced from said oscillating body in at least one direction substantially perpendicular to the axis of motion of said oscillating body;

a main frame, said main frame having a mass greater than the total mass of said oscillating body and said intermediate frame means;

first leaf spring means connecting said oscillating body to said intermediate frame means;

second leaf spring means connecting said intermediate frame means to said main frame;

each of said first leaf spring means and said second leaf spring means being disposed substantially perpendicular to the axis of motion of said oscillating body when said oscillating body is at rest;

said first leaf spring means having a larger spring constant than said second leaf spring means;

said first leaf spring means and said second leaf spring means having substantially the same degree of flex to cancel any displacements other than said oscillating body along its axis of motion so that said oscillating body has spatially linear motion along its axis of motion;

means to compensate for lost energy during movement of said oscillating body along its axis of motion;

support means to support said main frame, said main frame having vibrations relative to said support means;

and means to substantially prevent transmission of vibrations from said main frame to said support means.

2. The arrangement according to claim 1 in which:

said oscillating body includes:

first and second portions spaced from each other along the axis of motion of said oscillating body;

and means connecting said first portion and said second portion to each other;

said intermediate frame means includes:

a first intermediate frame space from said first portion of said oscillating body in a direction substantially perpendicular to the axis of motion of said oscillating body;

and a second intermediate frame space from said second portion of said oscillating body in a direction substantially perpendicular to the axis of motion of said oscillating body;

said first leaf spring means includes:

first separate leaf spring means connecting said first portion of said oscillating body and said first intermediate frame to each other;

and second separate leaf spring means connecting said second portion of said oscillating body and said second intermediate frame to each other;

and said second leaf spring means includes:

first separate leaf spring means connecting said first intermediate frame to said main frame;

and second separate leaf spring means connecting said second intermediate frame to said main frame.

3. The arrangement according to claim 2 including said first intermediate frame and said second intermediate frame being disposed on opposite sides of the axis of motion of said oscillating body.

4. The arrangement according to claim 3 including separate means to cause movement of each of said first intermediate frame and said second intermediate frame in a direction substantially parallel to the axis of motion of said oscillating body to change the spatially linear motion of said oscillating body to a different predetermined path.

5. The arrangement according to claim 4 including:

said oscillating body including printing means;

a recording medium cooperating with said printing means to record information produced thereon by said printing means;

relative moving means to create continuous relative movement between said recording medium and said oscillating body in a direction substantially perpendicular to the axis of motion of said oscillating body;

and the different predetermined path of said oscillating body compensating for continuous relative movement between said recording medium and said oscillating body.

6. The arrangement according to claim 5 in which said printing means includes a plurality of spaced printing elements on said oscillating body and spaced from each other in a direction along the axis of motion of said oscillating body.

7. The arrangement according to claim 4 including:

said oscillating body including printing means;

a recording medium cooperating with said printing means to record information produced thereon by said printing means;

and relative moving means to create relative movement between said recording medium and said oscillating body in a direction substantially perpendicular to the axis of motion of said oscillating body.

8. The arrangement according to claim 3 including means to introduce a phase shift between said first intermediate frame and said second intermediate frame to change the motion of said oscillating body from along the axis of motion of said oscillating body to a different predetermined path resembling the numeral eight on its side.

9. The arrangement according to claim 3 including:

said oscillating body including printing means;

a recording medium cooperating with said printing means to record information produced thereon by said printing means;

relative moving means to create continuous relative movement between said recording medium and said oscillating body in a direction substantially perpendicular to the axis of motion of said oscillating body;

and means to introduce a phase shift between said first intermediate frame and said second intermediate frame to change the motion of said oscillating body from along the axis of motion of said oscillating body to a path to compensate for continuous relative movement between said recording medium and said oscillating body.

10. The arrangement according to claim 9 in which said printing means includes a plurality of spaced printing elements on said oscillating body and spaced from each other in a direction along the axis of motion of said oscillating body when said introducing means does not introduce the phase shift.

11. The arrangement according to claim 1 in which:

said oscillating body includes:

a plurality of portions space from each other along the axis of motion of said oscillating body;

and means connecting said portions to each other;

said intermediate frame means includes a plurality of intermediate frames equal in number to the number of said portions of said oscillating body;

said first leaf spring means includes separate leaf spring means connecting each of said intermediate frames to one of said portions of said oscillating body;

and said second leaf spring means includes separate leaf spring means connecting each of said intermediate frames to said main frame.

* * * * *